United States Patent [19]

Kaneko et al.

[11] Patent Number: 5,024,388

[45] Date of Patent: Jun. 18, 1991

[54] STONEWORK CRUSHER

[75] Inventors: Katsuhiko Kaneko; Minoru Nishida, both of Kumamoto, Japan

[73] Assignees: Nishimatsu Co., Ltd.; Tokin Corporation, both of Japan

[21] Appl. No.: 446,754

[22] Filed: Dec. 6, 1989

[30] Foreign Application Priority Data

Dec. 9, 1988 [JP] Japan ..... 63-160262[U]

[51] Int. Cl.[5] ..... B02C 19/00; E21C 37/00

[52] U.S. Cl. ..... 241/301; 125/23.01; 299/20

[58] Field of Search ..... 299/14, 20, 21, 22, 299/23, 20; 125/23 R, 23 C, 23.01, 24; 241/1, 301, 65, 66, 67, 23, 262, 283

[56] References Cited

U.S. PATENT DOCUMENTS 4,740,036 4/1988 Cerny ..... 299/20 X

FOREIGN PATENT DOCUMENTS 61-169600 1/1985 Japan .

60-115794 11/1988 Japan .

1048115 10/1983 U.S.S.R. ..... 299/20

OTHER PUBLICATIONS

Clipping from Japanese economic newspaper "Nihon Keizai Shinbun".

*Primary Examiner*—Mark Rosenbaum

*Attorney, Agent, or Firm*—Lerner, David, Littenberg, Krumholz & Mentlik

[57] ABSTRACT

In construction of a stonework crusher utilizing thermal deformation of shape memory alloy, heating means is coupled to one or more insert heads made of shape memory alloy without leaving any space there between so that thermal deformation of the insert heads should pose no substantial influence upon heat transmission from the heating means. In particular when several crushers are used in combination, uniform heat transmission at different crushers allows concerted generation of crush force by the combined crushers for effective and efficient crushing of stoneworks.

13 Claims, 4 Drawing Sheets

STONEWORK CRUSHER

BACKGROUND OF THE INVENTION

The present invention relates to an improved stonework crusher, and more particularly relates to improvements in a shape memory alloy type crusher used for crushing stoneworks such as big stones, rocks and building structures made of stones or concretes.

Such a shape memory alloy (SMA) type stonework crusher is highly appreciated in the field of stonework construction because of its easy handling and relatively quick operation when compared with crushing via water expansion. Its safety in handling and operation is also highly welcomed in practice in particular in comparison with explosion type crushing which often endangers workers and ambient inhabitants and, as a consequence, is limited in application, due to its dangerous nature.

Some SMA type crushers are proposed in Japanese Patent Openings Sho. No. 60-115794 and Sho No. 61-169600. In construction of the crushers of these earlier proposals, a heating element situated at the center of a crusher is surrounded by a cylindrical shell made of SMA. In operation, the crusher is inserted into a bore or a groove naturally or artificially formed in a stonework and the cylindrical shell is heated by the heating element so that thermal deformation of the shell should apply a crush force to the walls of the bore or the groove to crush the stonework.

In the case of such a SMA type crusher, the cylindrical shell expands in all radial directions during the thermal deformation. In other words, the cylindrical shell expands into directions not contributing to enlargement of the bore or the groove and, as a consequence, the thermal deformation of the cylindrical shell cannot be fully utilized for generation of the crush force. In addition, thermal deformation of the cylindrical shell enlarges the space between the central heating element and the surrounding shell, thereby lowering efficiency in heat transmission to the shell. In particular when two or more stonework crushers are used in combination, variation in thermal deformation caused by such enlarged space between the heating element and the shell tends to impair concerted action of these crushers, thereby leading to unsuccessful crushing of the stonework.

In an attempt to measure the magnitude of a force necessary for successfully crushing a stonework, a series of experimental tests were conducted using rectangular concrete columns of various square sections. The height of each column was 200mm and the side length of the square was changed. A SMA rod of 10mm diameter and 20mm length was sued as a crusher. The rod had a built-in curvature about the middle of its length. After insertion into a vertical bore of 10mm diameter and 120mm. depth formed in the top face of the concrete column, the rod was heated to restore its built-in curvature. As a result of the test, it was confirmed that the concrete columns could be successfully crushed only when the side length of the square section was ⅓ or smaller than the length of the SMA rod. This results indicates the fact that, in order to crush a big stonework, crusher rods have to be arranged in a bore or groove in the stonework at an interval of about 2 times as large as the diameter of the rod whilst necessitating great deal of labour and time. From these experimental data, it is well understood that a large force is necessary to crush a stonework.

For these reasons, most of the conventional SMA-type crushers have not been widely used in practice. Even when used, it is inevitably accompanied with increased labour, time and cost.

SUMMARY OF THE INVENTION

It is the object of the present invention to provide a practical SMA-type crusher of stoneworks which can exhibit a large crush force with high and uniform heat transmission.

In accordance with the basic concept of the present invention, at least one insert head is made of SMA and a pair of abutments are attached to opposite outer faces of the insert head.

Most preferably, the pair of abutments are spaced apart from each other in the direction of thermal deformation of the insert head.

DESCRIPTION OF THE PREFERRED EMBODIMENTS

Figure 1:
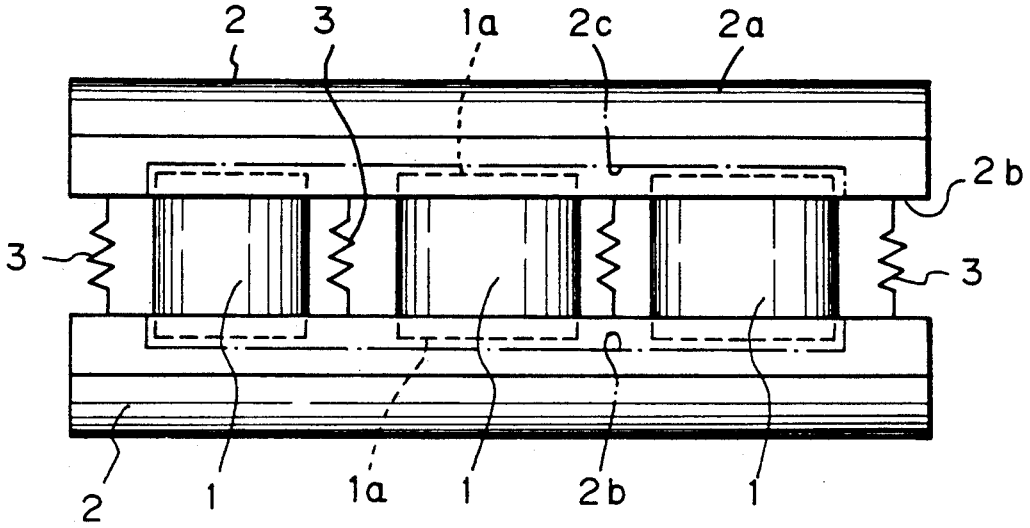
FIG. 1 is a side view of one embodiment of the stonework crusher in accordance with the present invention.
Figure 2:
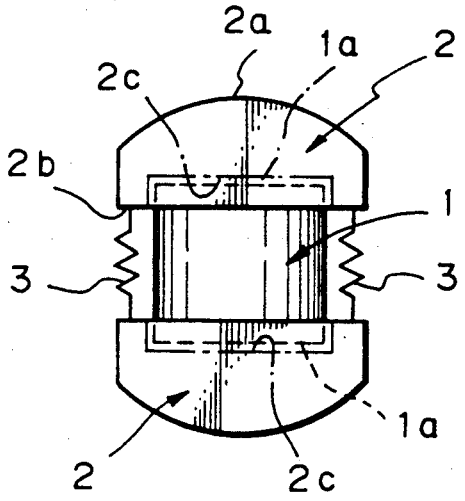
FIG. 2 is an end view of the crusher shown in FIG. 1.

One embodiment of the stonework crusher in accordance with the present invention is shown in FIGS. 1 and 2, in which the crusher is comprised of three insert heads 1 made of SMA, a pair of abutments 2 sandwiching the insert heads 1 and a proper heating means. Each abutment 2 is provided with a convex outer face 2*a* and a flat inner face 2*b* and a hollow 2*c* is formed in the inner face 2*b* for reception of the insert heads 1. The curvature of the outer face 2*a* of the abutment 2 is preferably selected so as to match that of the wall of a bore or a groove into which the crusher is to be inserted in operation.

Figure 3:
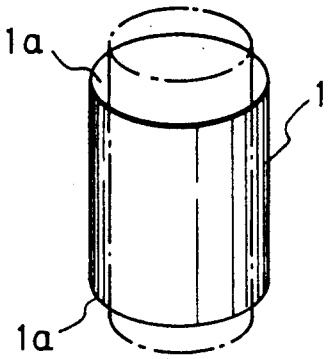
FIG. 3 is a perspective veiw of one example of the insert head used for the crusher shown in FIGS. 1 and 2.

In the case of this example, each insert head 1 is given in the form of a circular cylinder such as shown in FIG. 3 which is designed to increase its axial length by thermal deformation. More specifically in FIG. 3, the insert head 1 is deformed from the shape shown with solid lines to the shape shown with chain lines by application of head. The insert heat 1 may be given in other forms such as, for example, a rectangular cylinder as long as it increases the axial length by thermal deformation. The insert head 1 may be made of a shape memory alloy which restores its built-in shape by change in temperature but does not restore its usual shape when the temperature resumes its normal level. The insert head 1 may also be made of a shape memory alloy which restores its built-in shape by change in temperature and again restores its usual shape when the temperature resumes its normal level.

The insert heads 1 are assembled with the abutments in an arrangement such that both longitudinal ends 1*a* of each insert head 1 should be placed in contact with the hollows 2*c* in the abutments 2. In other words, the abutments 2 are spaced apart from each other in the direction of thermal deformation of the insert heads 1. Sandwiching the insert heads 1 in such an arrangement, the abutments 2 may act as a housing of the crusher. Though not illustrated, the crusher is further provided with a proper heating means.

The abutments 2 are connected to each other by means of a plurality of elastic connectors 3 so that they can change the intervening distance following thermal deformation of the insert heads 1. When the shape memory alloy restores its usual shape after removal of the change in temperature, use of these elastic connectors 3 expedites restoration of the initial position of the abutments 2. Tension springs are used for the elastic connector 3 in the case of the illustrated example. Other materials such as rubber bands may be used to this end too.

In one preferred embodiment of the heating means, the abutments 2 are given in the form of electrodes connected to a given power source. In such a case, the elastic connectors 3 are preferably electrically insulated from the abutments 2 so as to prevent formation of short circuits. Conversely the elastic connectors 3 may be made of an alloy of high resistance such as tungsten alloys for additional heating of the insert heads 1.

Figure 4:
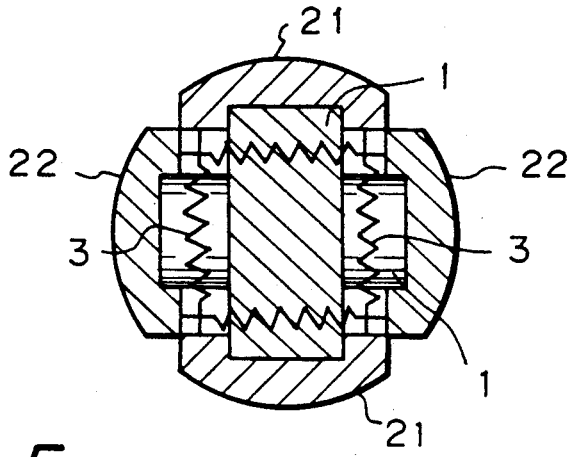
FIG. 4 is a transverse sectional view of another embodiment of the crusher in accordance with the present invention.

Another embodiment of the crusher in accordance with the present invention is shown in FIG. 4 in which the crusher is two-directional in operation. The crusher includes two groups of insert heads 21 and 22, each group being accompanied with a pair of abutments 2. More specifically, the direction of thermal deformation of an insert head 1 of one group is substantially normal to that of an insert head 1 of the other group. Preferably, the insert heads 1 of one group and the insert heads 1 of the other group are arranged at alternate positions. The crusher of this two-directional type is particularly suited for use in a bore.

Figure 5:
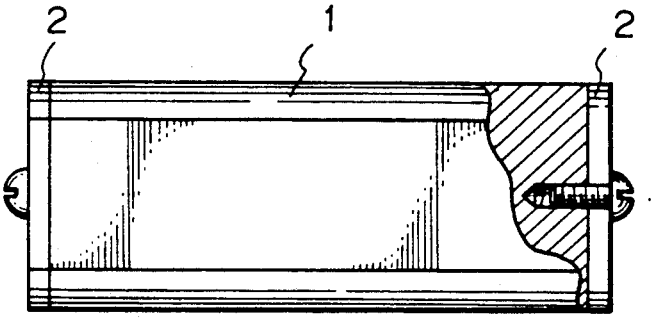
FIGS. 5 and 6 are side sectional and end views of another embodiment of the stonework crusher in accordance with the present invention.
Figure 7:
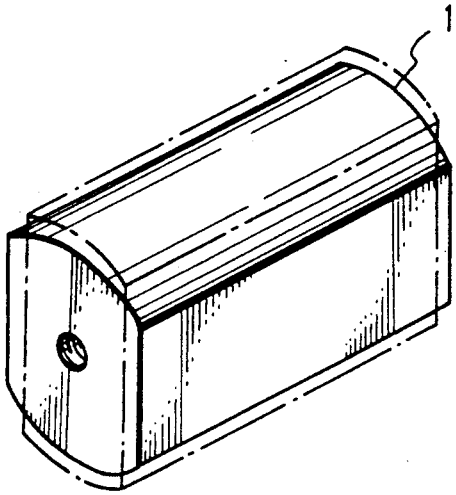
FIG. 7 is a perspective view of one example of the insert head used for the crusher shown in FIGS. 5 and 6, FIGS. 8 and 9 are partly sectional side and end views of the other embodiment of the stonework crusher in accordance with the present invention.
Figure 6:
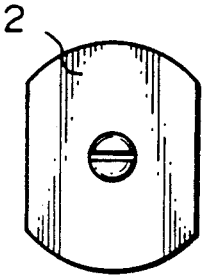

When the abutments 2 are expected to act as the heating means rather than as contact faces, they may be spaced apart from each other in a direction different from the direction of thermal deformation of the insert heads 1. Such an example is shown in FIGS. 5 and 7. In this case, the insert head 1 is deformed from the shape shown with solid lines to the shape shown with chain lines in FIG. 7. In other words, the abutments 2 are spaced apart from each other in a direction substantially normal to the direction of thermal deformation of the insert head 1. Further, the pair of abutments 2 are connected to each other by the insert head 1 to which the abutments are secured via set screws.

Figure 8:
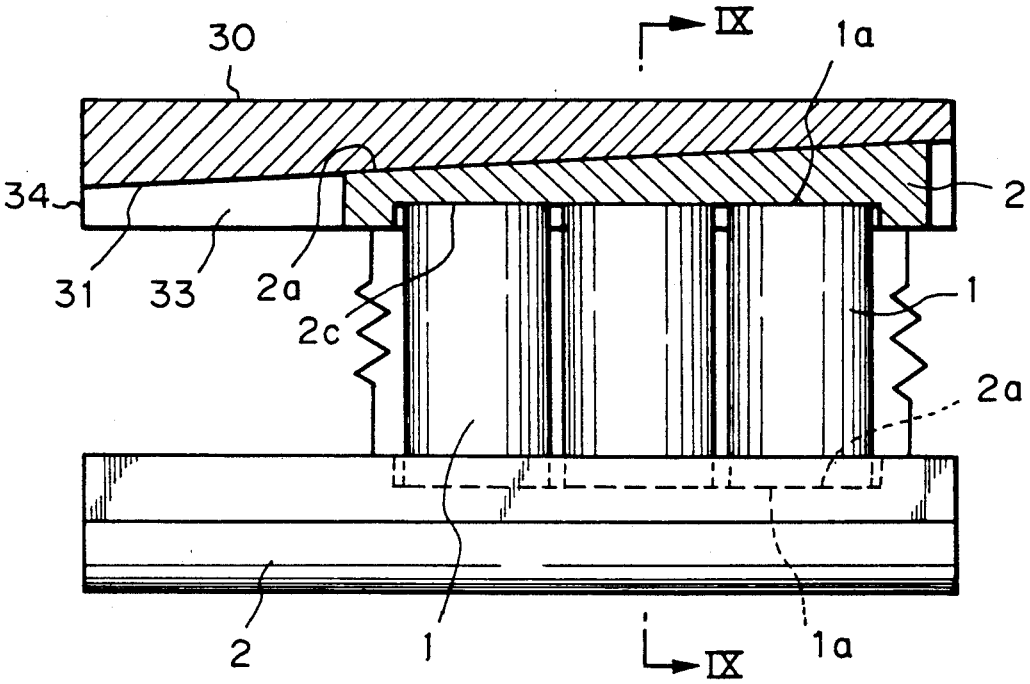
Figure 9:
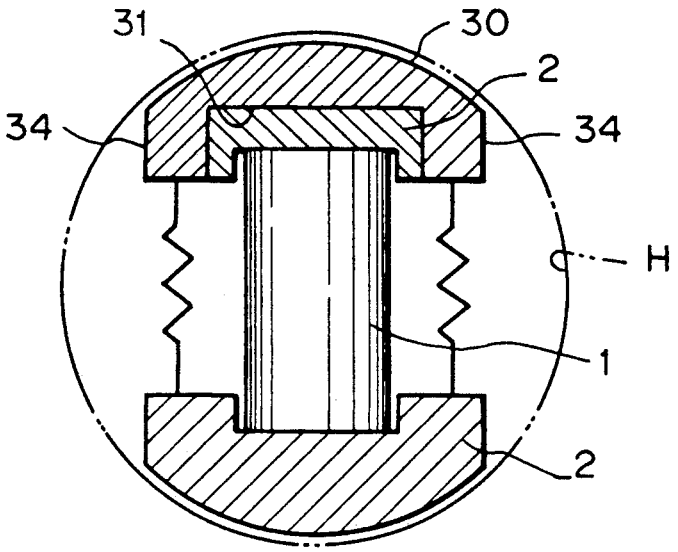

The other embodiment of the stonework crusher in accordance with the present invention is shown in FIGS. 8 and 9 in which, as in the case of the first embodiment shown in FIG. 1, juxtaposed insert heads 1 are sandwiched by a pair of abutments 2 connected to each other via elastic connectors 3 in the form of tension springs. The outer face 2*a* of at least one of the abutments 2 is sloped in the direction of juxtaposition of the insert heads 1. More specifically, the outer face 2*a* is given in the form of a slope which has an uprising gradient from the inserting end (the left end in the illustration) to the tail end (the right end in the illustration) of the crusher. In combination with this sloped outer face 2*a* of the abutment 2, the crusher is further provided with a wedge 30. This wedge 30 is provided with an elongated grove 33 having a sloped bottom 31 tightly engageable with the sloped outer face 2*a* of the abutment 2. Near the inserting end of the crusher, the wedge 30 is provided with a pair of projecting skirts 34 on both sides of the groove 33 as best seen in FIG. 9. In other words, the wedge 30 embraces the abutment 2 near the inserting end of the crusher.

When the inserting end of the crusher of this construction is inserted into a bore H shown with two dot chain lines in FIG. 9, the tail end of the crusher projects outside the bore H for convenience in forced insertion of the crusher into the bore H.

Preferably, parallel corrugations are formed in the outer face 2*a* of the abutment 2 and the bottom 31 of the groove 33 in the wedge 30 whilst extending in the direction of the juxtaposition of the insert heads 1 so that, at forced insertion of the crusher into the bore H, no lateral slippage should occur between the abutment 2 and the wedge 30.

Figure 10:
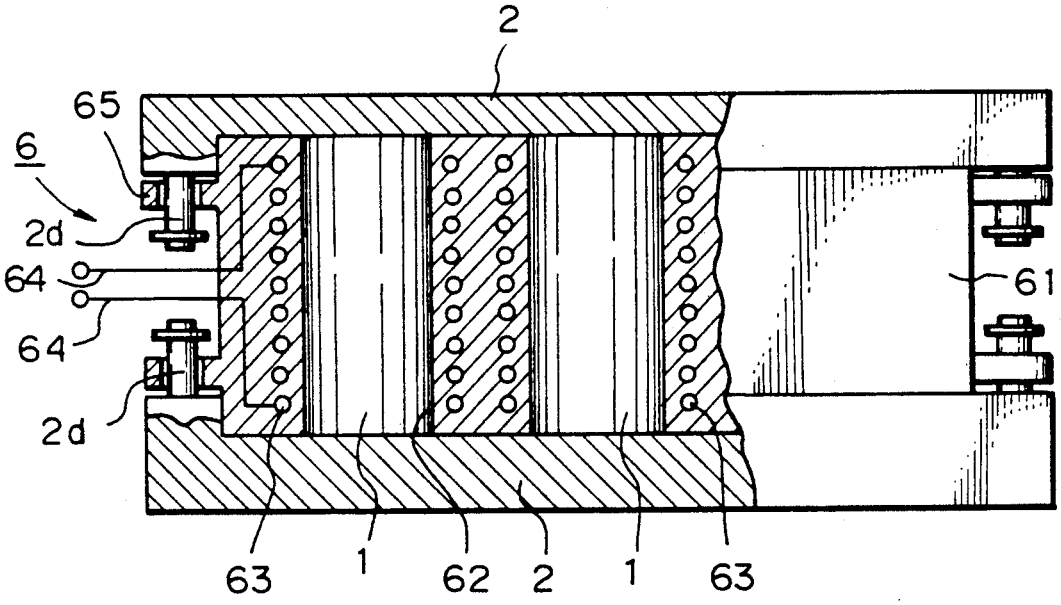
FIG. 10 is a partly sectional side view of the other embodiment of the stonework crusher in accordance with the present invention.

The other embodiment of the crusher in accordance with the present invention is shown in FIG. 10 in which the heating means is given in the form of a built-in type heater unit 6. More specifically, the heater unit 6 includes a block interposed between the pair of abutments 2 and provided with through holes 62 for accommodating the insert heads 1. Healing coils 63 are embedded in the block 61 whilst surrounding the holes 62. The heating coils 63 are connected to a given power source (not shown) via conductors 64. Each abutment 2 is provided at each end of the crusher with a pin 2*d* projecting into a space between the abutments 2. The block 61 is provided, in the vicinity of the pin 2*d* on the abutment 2, with a tongue 65 which is provided with a through hole for passage of the pin 2*d*. The pin 2*d* is idly inserted into the hole in the tongue 65, the length of the pin 2*d* is larger than the thickness of the tongue 65 and the pin 2*d* is provided, at its distal end, with a snap ring so that the abutments 2 should be separably connected to the block 61.

In accordance with the present invention, there is no space between the heating means and the insert head or heads made of SMA and, as a consequence, the distance between the heating means and the insert heads remains unchanged even after thermal deformation of the insert heads, thereby mitigating change and variation in heat transmission. In particular when two or more crushers are used in combination, the uniform heat transmission assures effective and efficient crushing of stoneworks. When the abutments are spaced apart from each other in the direction of thermal deformation of the insert heads, crush force generated by the thermal deformation of the insert heads can be most effectively utilized for crushing operation.

We claim:

1. An improved stonework crusher comprising at least one insert head made of shape memory alloy, a pair of abutments attached at opposite outer faces of said at least one insert head, means for connecting said pair of abutments while allowing for a change in distance between said abutments, and means for heating said at least one insert head.

2. An improved stonework crusher as claimed in claim 1 in which said pair of abutments are spaced apart from each other in a direction substantially normal to the direction of thermal deformation of said at least one insert head.

3. An improved stonework crusher as claimed in claim 1 or 2 in which two groups of insert heads are provided, and the direction of thermal deformation of said insert head or heads of one group is substantially normal to that of said insert head or heads of the other group.

4. A stonework crusher as claimed in claim 3 in which said insert heads of said one group and said insert heads of said the other group are arranged at alternate positions.

5. An improved stonework crusher as claimed in claim 1 or 2 in which said connecting means is formed by at least one elastic connector.

6. An improved stonework crusher as claimed in claim 5 in which said elastic connector is a tension spring.

7. An improved stonework crusher as claimed in claim 1 or 2 in which said connecting means is said insert head.

8. An improved stonework crusher as claimed in claim 1 or 2 in which the top face of at least one abutment of said pair of abutments is sloped, and a wedge is provided which has a groove tightly engageable with said top face of said abutment.

9. An improved stonework crusher as claimed in claim 8 in which said top face of said abutment and the bottom of said groove in said wedge are both provided with parallel corrugations extending in the longitudinal direction of said groove.

10. An improved stonework crusher as claimed in claim 1 or 2 in which said abutments is given in the form of electrodes connected to a given power source so as to act as a heating means.

11. An improved stonework crusher as claimed in claim 1 or 2 in which said heating means includes a block interposed between said abutments and internally accommodating said insert heads and heating coils embedded in said block in connection with a given power source whilst surrounding said insert heads.

12. An improved stonework crusher comprising at least one insert head made of shape memory alloy, a pair of abutments attached to opposite outer faces of said at least one insert head, said pair of abutments being spaced apart from each other in a direction substantially normal to the direction of thermal deformation of said at least one insert head, and means for connecting said pair of abutments while allowing for a change in distance between said abutments, said abutments comprising electrodes adopted to act as heating means for said at least one insert head.

13. An improved stonework crusher comprising at least one insert head made of shape memory alloy, a pair of abutments attached to opposite outer faces of said at least one insert head, said pair of abutments being spaced apart from each other in a direction substantially normal to the direction of thermal deformation of said at least one insert head, means for connecting said pair of abutments while allowing for a change in distance between said abutments, a block interposed between said pair of abutments while internally accommodating said at least one insert head, and heating coils embedded in said block while surrounding said at least one insert head so as to act as heating means for said at least one insert head.

* * * * *

UNITED STATES PATENT AND TRADEMARK OFFICE

CERTIFICATE OF CORRECTION

PATENT NO. : 5,024,388

DATED : 6/18/91

INVENTOR(S) : Kaneko et al.

It is certified that error appears in the above-identified patent and that said Letters Patent is hereby corrected as shown below:

Column 1, line 55, "sued" should read --used--

Column 2, line 65, "head" should read --heat--

Column 2, line 65, "heat" should read --head--

Signed and Sealed this

Twentieth Day of October, 1992

*Attest:*

DOUGLAS B. COMER

*Attesting Officer*

*Acting Commissioner of Patents and Trademarks*